US005626263A

United States Patent [19]

Lii

[11] Patent Number: 5,626,263

[45] Date of Patent: May 6, 1997

[54] C-CLAMP ASSEMBLY

[76] Inventor: Liang-Kuen Lii, 58, Ma Yuan West St., Taichung, Taiwan

[21] Appl. No.: 667,720

[22] Filed: Jun. 21, 1996

[51] Int. Cl.[6] ..... B67D 5/06

[52] U.S. Cl. ..... 222/192; 222/326; 222/391; 269/6

[58] Field of Search ..... 222/191, 192, 222/326, 327, 391, 386; 269/3, 6, 216, 228, 249

[56] References Cited

U.S. PATENT DOCUMENTS 4,874,155 10/1989 Goul ..... 269/6

5,217,213 6/1993 Lii ..... 269/6

5,549,225 8/1996 Lii ..... 222/192

*Primary Examiner*—Philippe Derakshani

[57] ABSTRACT

A C-clamp assembly has a fixed handle, a circular holding seat disposed in a front of the fixed handle, a driving handle inserted in an interior of the fixed handle, a push rod passing through the circular holding seat and the fixed handle transversely, a movable jaw disposed in a front end of the push rod, a generally C-shaped frame extending from the circular holding seat transversely, an elastic clamp device positioned on the generally C-shaped frame, and a fixed jaw disposed on a front end of the generally C-shaped frame.

1 Claim, 5 Drawing Sheets

C-CLAMP ASSEMBLY

BACKGROUND OF THE INVENTION

The invention relates to a C-clamp assembly. More particularly, the invention relates to a C-clamp assembly with an adhesive spreader.

The adhesive spreader can spread silicone, size, paste, and other adhesives. Most conventional adhesive spreaders cannot be converted to C-clamp devices. Most conventional C-clamp devices cannot be converted to adhesive spreaders.

SUMMARY OF THE INVENTION

An object of the invention is to provide an adhesive spreader which can be operated efficiently.

Another object of the invention is to provide a C-clamp device which can be converted to an adhesive spreader.

Accordingly, a C-clamp assembly comprises a fixed handle, a circular holding seat disposed in a front of the fixed handle, a driving handle inserted in an interior of the fixed handle, a push rod passing through the circular holding seat and the fixed handle transversely, a movable jaw disposed in a front end of the push rod, a generally C-shaped frame extending from the circular holding seat transversely, an elastic clamp device positioned on the generally C-shaped frame, and a fixed jaw disposed on a front end of the generally C-shaped frame. An arc end is formed on the front end of the generally C-shaped frame. An arc plate engages with the arc end. The fixed jaw which has a lobe is positioned between the arc plate and the arc end. A rear end of the generally C-shaped frame is inserted in a spacing beneath the circular holding seat and positioned by a plurality of fasteners. The elastic clamp device has a bottom recess to receive the generally C-shaped frame. Two outcurved plates extend upward from the elastic clamp device. Two lips are formed on distal ends of the outcurved plates, respectively. The fixed jaw is detached from the front end of the generally C-shaped frame. An adhesive spreader is inserted in the elastic clamp device via two lips and clamped by two outcurved plates. A rear end of the adhesive spreader is blocked by the circular holding seat. A nozzle of the adhesive spreader is inserted through a round hole defined by the arc plate and the arc end.

DETAILED DESCRIPTION OF THE INVENTION

Figure 1:
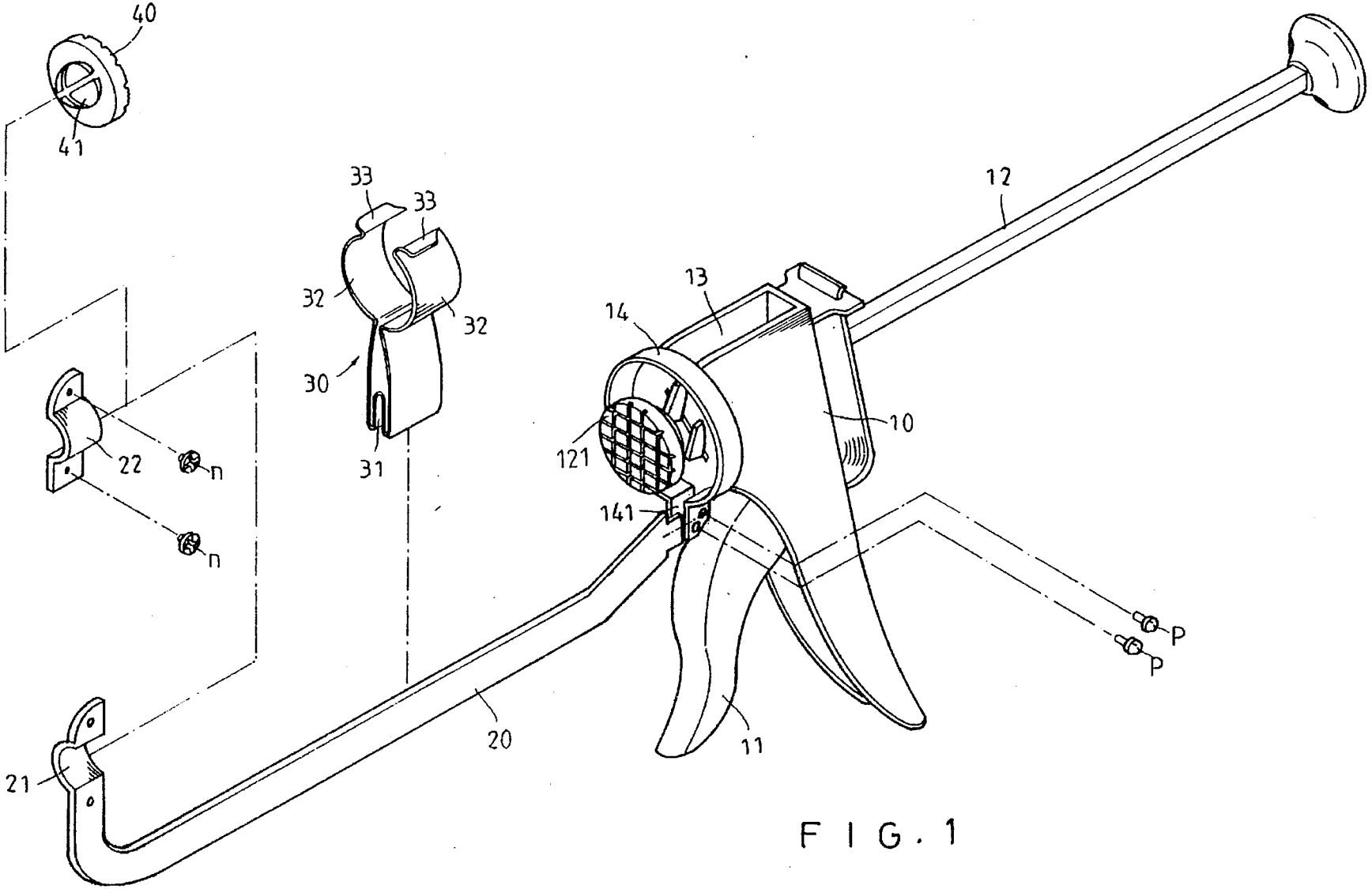
FIG. 1 is a perspective exploded view of a C-clamp assembly of a preferred embodiment in accordance with the invention.
Figure 2:
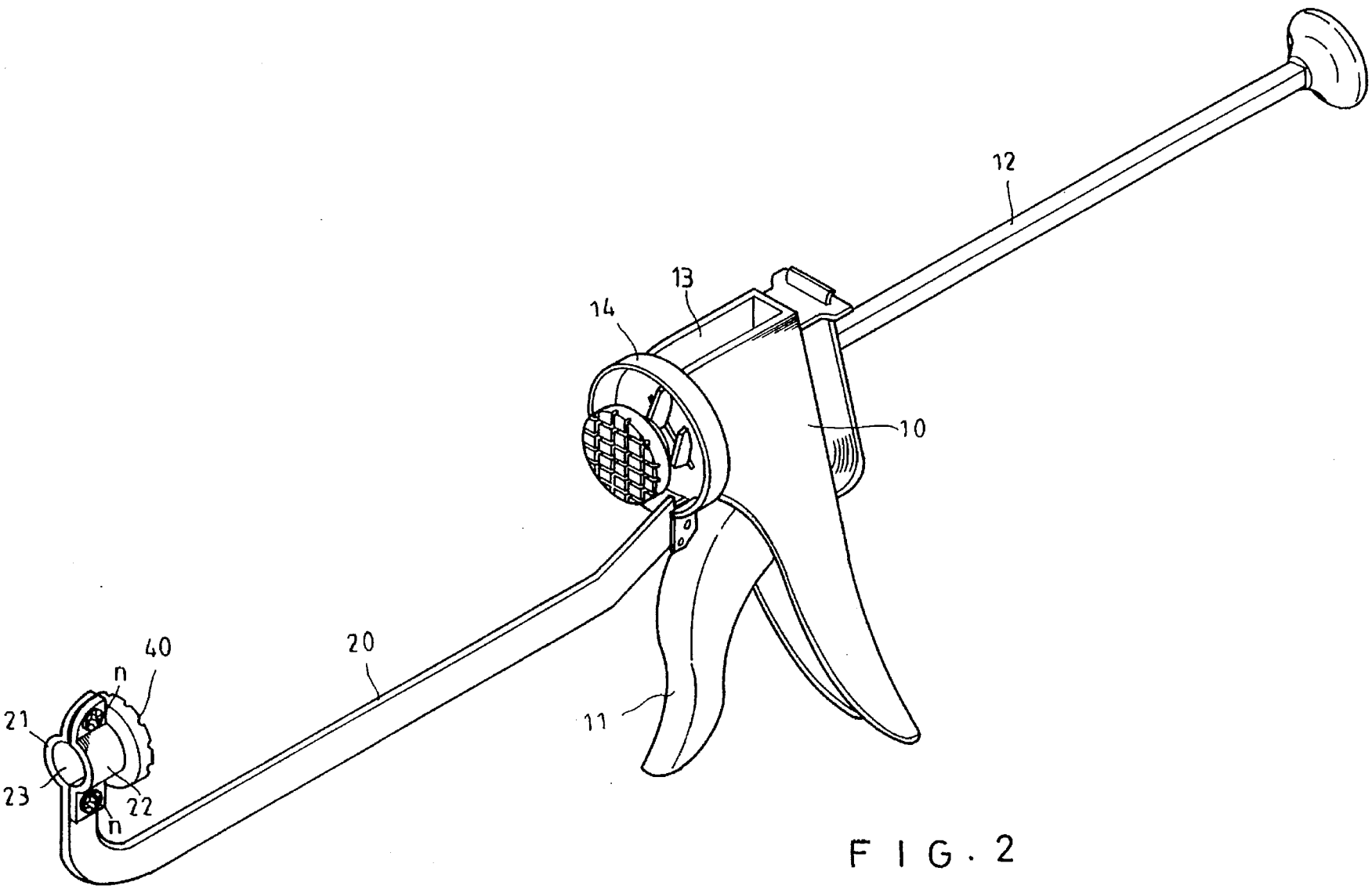
FIG. 2 is a perspective exploded view of a C-clamp device of a preferred embodiment in accordance with the invention.
Figure 3:
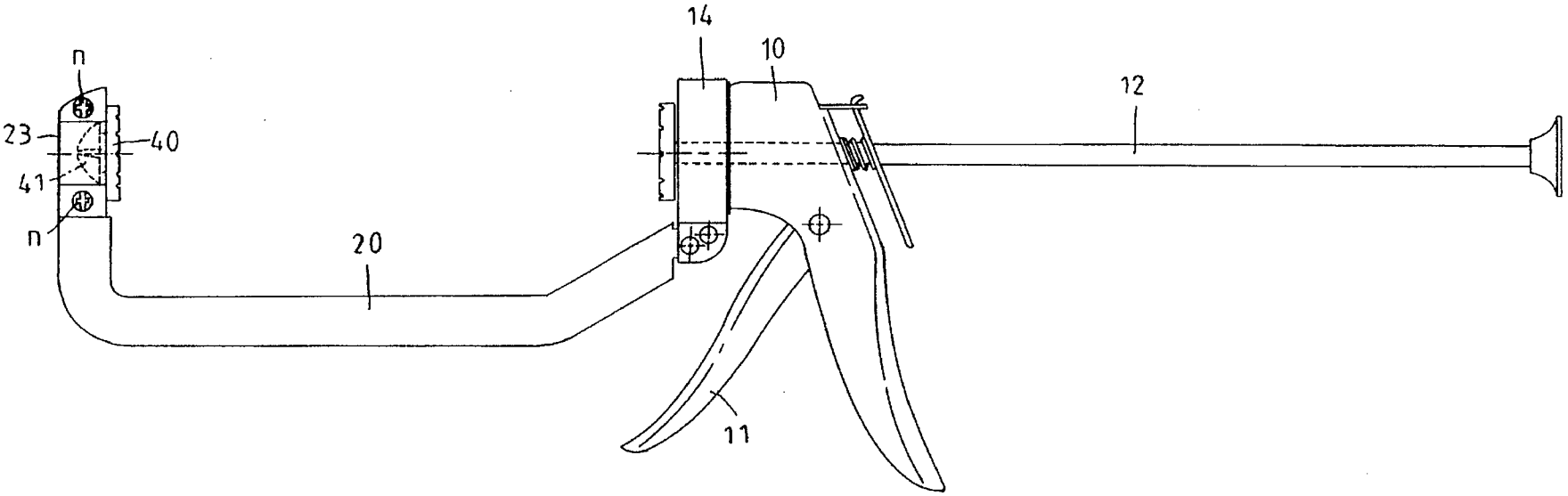
FIG. 3 is a side elevational view of FIG. 2.

Referring to FIGS. 1 to 3, a C-clamp assembly has a fixed handle 10, a circular holding seat 14 disposed in a front of the fixed handle 10, a driving handle 11 inserted in an interior 13 of the fixed handle 10, a push rod 12 passing through the circular holding seat 14 and the fixed handle 10 transversely, a movable jaw 121 disposed in a front end of the push rod 12, a generally C-shaped frame 20 extending from the circular holding seat 14 transversely, an elastic clamp device 30 positioned on the generally C-shaped frame 20, and a fixed jaw 40 disposed on a front end of the generally C-shaped frame 20. An arc end 21 is formed on the front end of the generally C-shaped frame 20. An arc plate 22 is engaged with the arc end 21 and fastened by a plurality of screws n. The fixed jaw 40 which has a lobe 41 is positioned between the arc plate 22 and the arc end 21. A rear end of the generally C-shaped frame 20 is inserted in a spacing 141 beneath the circular holding seat 14 and positioned by a plurality of fasteners p. The elastic clamp device 30 has a bottom recess 31 to receive the generally C-shaped frame 20. Two outcurved plates 32 extend upward from the elastic clamp device 30. Two lips 33 are formed on distal ends of the outcurved plates 32, respectively.

Figure 4:
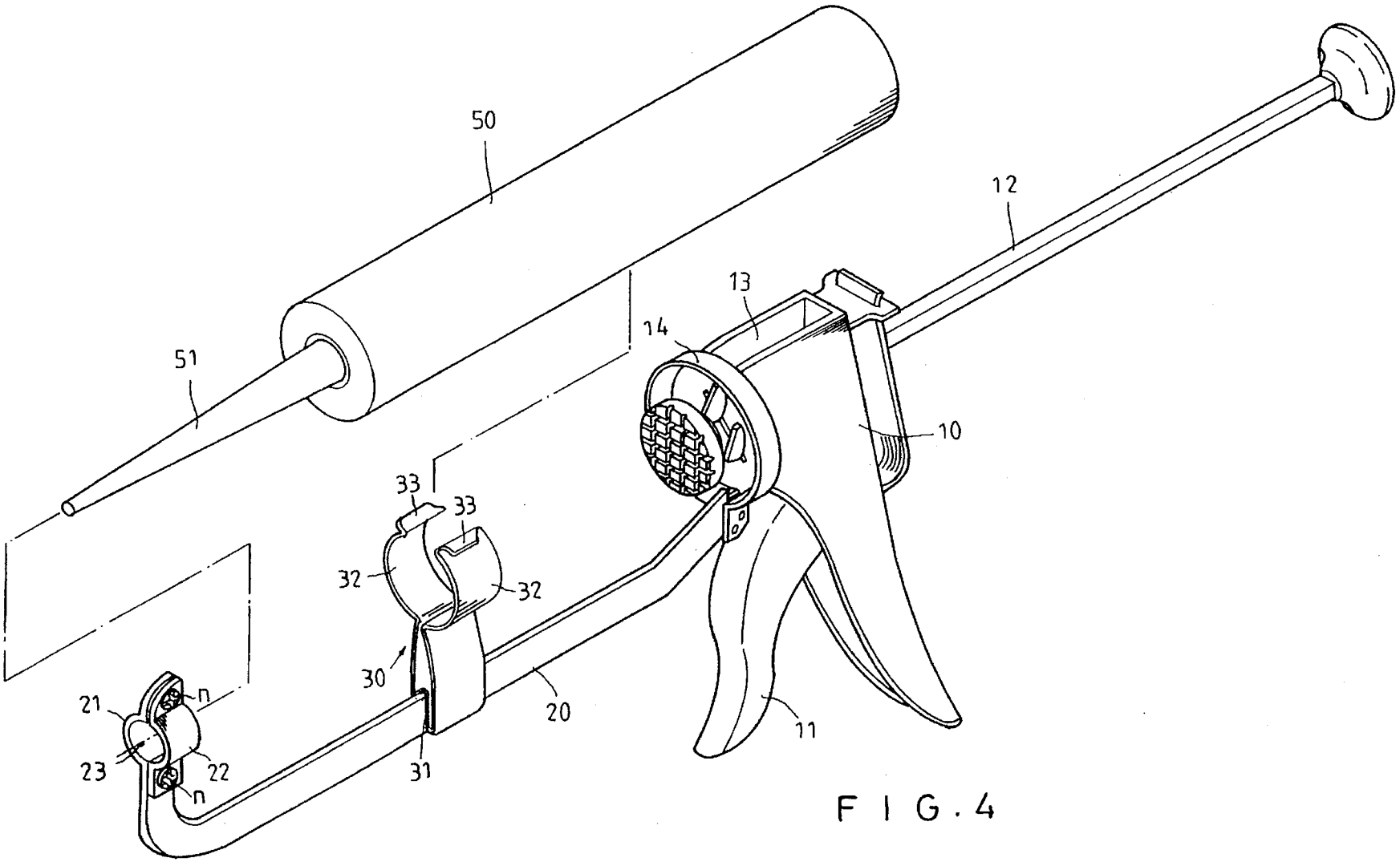
FIG. 4 is a perspective view of a C-clamp assembly and an adhesive spreader.
Figure 5:
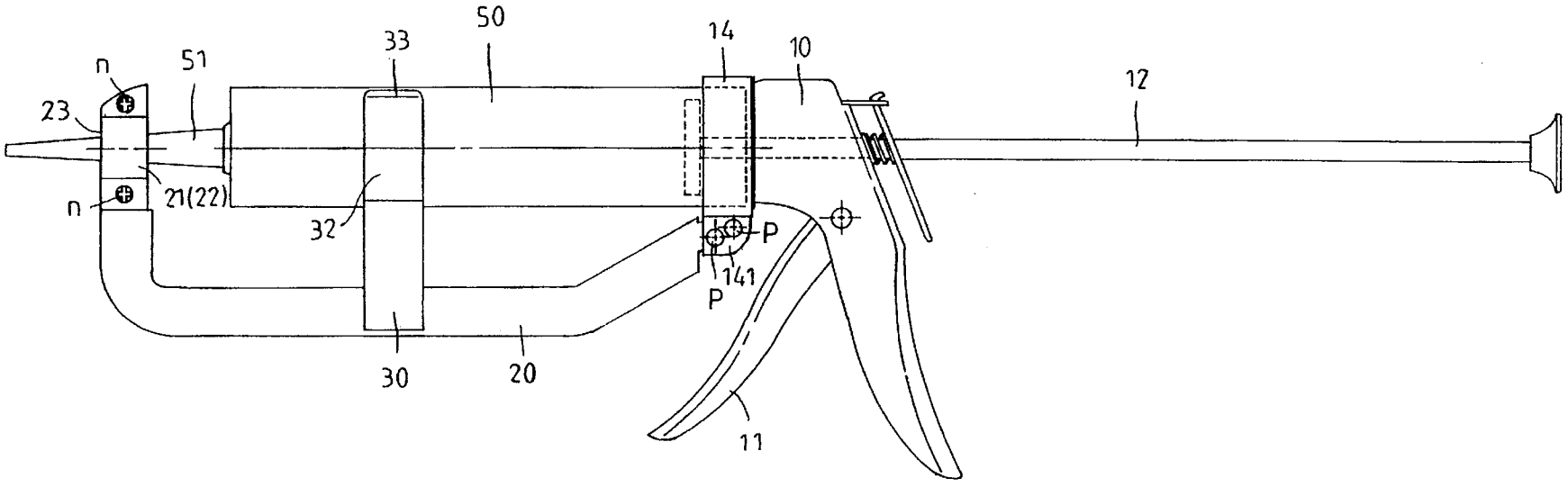
FIG. 5 is a side elevational view of FIG. 4.

Referring to FIGS. 4 and 5, the fixed jaw 40 is detached from the front end of the generally C-shaped frame 20. An adhesive spreader 50 is inserted in the elastic clamp device 30 via two lips 33 and clamped by two outcurved plates 32. A rear end of the adhesive spreader 50 is blocked by the circular holding seat 14. A nozzle 51 of the adhesive spreader 50 is inserted through a round hole 23 defined by the arc plate 22 and the arc end 21.

The invention is not limited to the above embodiments but various modification thereof may be made. It will be understood by those skilled in the art that various changes in form and detail may be made without departing from the scope of the invention.

I claim:

1. A C-clamp assembly comprising:

a fixed handle;

a circular holding seat disposed in a front of the fixed handle;

a driving handle inserted in an interior of the fixed handle;

a push rod passing through the circular holding seat and the fixed handle transversely;

a movable jaw disposed in a front end of the push rod;

a generally C-shaped frame extending from the circular holding seat transversely;

an elastic clamp device positioned on the generally C-shaped frame;

a fixed jaw disposed on a front end of the generally C-shaped frame;

an arc end formed on the front end of the generally C-shaped frame;

an arc plate engaged with the arc end and fastened by a plurality of screws;

the fixed jaw which has a lobe positioned between the arc plate and the arc end;

a rear end of the generally C-shaped frame inserted in a spacing beneath the circular holding seat and positioned by a plurality of fasteners;

the elastic clamp device having a bottom recess to receive the generally C-shaped frame;

two outcurved plates extending upward from the elastic clamp device; and two lips formed on distal ends of the outcurved plates, respectively.

* * * * *